United States Patent [19]

Newcomb et al.

[11] Patent Number: 4,846,475

[45] Date of Patent: Jul. 11, 1989

[54] ILLUMINATED TRANSLUCENT HOCKEY PUCK

[76] Inventors: Nelson F. Newcomb; Nelson F. Newcomb, Jr., both of Windleblo Rd., Mirror Lake, N.H. 03853

[21] Appl. No.: 148,259

[22] Filed: Jan. 25, 1988

[51] Int. Cl.[4] ..... A63B 71/02

[52] U.S. Cl. ..... 273/128 R; 273/DIG. 24; 273/DIG. 4; 273/DIG. 5; 362/34; 362/84

[58] Field of Search ..... 273/DIG. 24, DIG. 4, 273/DIG. 5, 128 R, 1 B; 362/108, 34, 84, 103

[56] References Cited

U.S. PATENT DOCUMENTS

| | | | |
|---|---|---|---|
| 2,874,964 | 2/1959 | Edwards | 273/DIG. 5 |
| 3,887,188 | 6/1975 | Beauchamp et al. | 273/128 R |
| 3,918,719 | 11/1975 | Welch | 273/DIG. 24 |
| 4,015,111 | 3/1977 | Spector | 273/DIG. 24 |
| 4,183,536 | 1/1980 | Platt | 273/128 R |
| 4,328,533 | 5/1982 | Paredes | 362/108 |
| 4,479,649 | 10/1984 | Newcomb et al. | 273/DIG. 24 |

*Primary Examiner*—Edward M. Coven
*Assistant Examiner*—Benjamin Layno
*Attorney, Agent, or Firm*—Ernest V. Linek

[57] ABSTRACT

The present invention is directed to an illuminated hockey puck used for playing hockey after dark. The puck is made of translucent plastic and has a passageway or hole extending diametrically through the puck. Inside the passageway is a readily replaceable, chemiluminescent light stick, which when activated renders the puck plainly visible when used in the dark.

7 Claims, 1 Drawing Sheet

ILLUMINATED TRANSLUCENT HOCKEY PUCK

BACKGROUND OF THE INVENTION

It is well known that the game of ice hockey can generally be played in either a lighted indoor or outdoor ice rink, or during daylight on any convenient frozen pond, lake, or other suitable ice-covered surface. Clearly, the ice surfaces provided by mother nature during the winter are one of the most economical arenas for the playing of ice hockey, and also, the forum of choice for most young hockey players. However, as stated above, these "free" arenas are generally limited to daylight play.

Any device which would make available the extended use of these naturally free arenas, e.g., for playing ice hockey after school, in the early evening, etc., would be a most sought after and worthwhile invention, especially to the grade school, junior high school, and high school age children living in the northern United States and Canada, for whom the playing of ice hockey during the winter is a most popular sport.

At least one attempt has been made to provide a hockey puck which would be sufficiently visible in the dark so that limited play of ice hockey might be attempted on unlighted ice. Such a puck is described in U.S. Pat. No. 4,183,536 to Nicholas W. Platt of Madison, N.J. (hereinafter, the "Platt puck").

The Platt puck comprises a translucent cylindrical impact member (or puck part) from which there is carved out of the central axial core a cavity (akin to a partial dough-nut hole). Into this partial void there is inserted a chemiluminescent light means. The light means is retained in this axial cavity by means of a plug.

In one illustrated embodiment of the Platt puck, two separate chemiluminescent chemicals are retained in separate portions of the axial cavity, and are mixed by throwing the puck on the ice, rupturing a barrier placed between the chemicals. On mixing, these two chemicals produce a chemiluminescent light which lasts for a few hours. Thus, there is taught a "one-time" glow-in-the-dark hockey puck which can only be used once for playing ice hockey in the dark.

The complicated structure of this puck is believed to be one reason why there has been no apparent commercialization of the device. Another apparent reason for a lack of commercialization, is the apparent "disposable" nature of the preferred embodiment. Clearly, if any part of a glow-in-the-dark hockey puck is to be disposable and/or preferably replaceable, it should be the source of illumination, not the entire puck assembly.

The present invention represents a significant improvement over the Platt puck, and provides for both simple and economical construction of an illuminated or glow-in-the-dark hockey puck, which utilizes a commercially available, and readily replaceable chemiluminescent light stick as the source of illumination.

SUMMARY OF THE INVENTION

The puck of the present invention is completely different from all hockey pucks now commonly in use in that it is made from translucent plastic or mixtures of translucent plastics as a one piece unit, by known methods such as for example cast molding, injection molding or reaction injection molding. As used herein, the term "translucent plastic" includes all of the well known transparent plastics available commercially.

The hockey puck of the present invention has one added feature which will further distinguish it from conventional and/or other prior art hockey pucks. This feature is a permanent hole extending longitudinally through the diameter of the puck.

The purpose of the hole is to make possible the acceptance therein of a chemiluminescent light stick now commonly available in the marketplace. The purpose of the light stick when activated and placed in the hole is to create a sufficient degree of illumination of the puck so that it is clearly visible in the dark, in flight or on the ice.

The simple, one piece molded construction of the present hockey pucks, combined with the use therein of a commercially available, and hence readily replaceable source of illumination, renders the hockey pucks of the present invention vastly superior to those previously proposed for use after dark.

This permanent longitudinal/diametrical hole is also to be contrasted with the axial cavity of the Platt puck. The puck of the present invention utilizes the entire three inch diametrical width of a conventional hockey puck to define the space occupied by the illumination means. In contrast thereto, the axial cavity of the Platt puck relies upon only a portion of the central core, about one-third of the diameter, by less than one inch deep, to confine the light producing materials.

In the puck of the present invention the hole is preferably about 7.5 mm in diameter and is virtually unnoticeable in ordinary inspection when the puck is on the ice. In addition, the hole has no effect on the puck in use.

The longitudinal/diametrical hole is created through the puck of the present invention, either during the molding process, or after puck formation, e.g., by drilling a hole of sufficient size to accept and retain a commercially available chemiluminescent light stick. In preferred embodiments, the light stick used is the 7.5 mm×75 mm YELLOW CYALUME light stick available from American Cyanamid Co. as Product No. D95281-12.

The puck may be of any size and weight, but is typically about three inches in diameter by one inch in depth, and weighs up to about six ounces.

In a preferred form, especially useful for the playing of hockey in diminished light situations, the puck of the present invention is made in the size dimensions stated above, but lighter than a conventional hockey puck, most preferably about one-half the weight of a conventional 6 oz. hockey puck. The use of a lighter than normal puck reduces the potential for causing injury, and requires the use of less plastic material, thereby making the product both safer and cheaper than other hockey pucks.

Thus, the present invention is directed to a hockey puck structure consisting of a substantially cylindrical, one piece translucent plastic mass having the shape and size of a conventional hockey puck. The puck is provided with a diametrically, longitudinally extending passageway which will accept and retain a replaceable chemiluminescent light stick therein. The preferred light stick for use herein is commercially available from American Cyanamid Co. under the tradename, CYALUME.

As used herein, the terms "night" and "after dark" shall include all times during which the visibility of a conventional hockey puck would be reduced or impaired, including, but not limited to, dusk, dawn, twilight, heavily overcast daytime, fog, rain, snow, and the like. Thus, "night hockey" is meant to encompass not only total darkness, but also any time and/or weather conditions which would be benefited by the use of the hockey puck of the present invention.

DETAILED DESCRIPTION OF A PREFERRED EMBODIMENT

Figure 1:
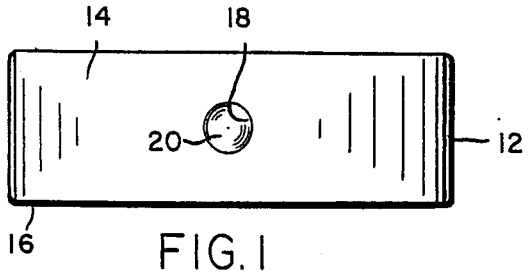
FIG. 1 is a longitudinal view of the ice hockey puck of the present invention, illustrating the diametrical hole into which the light stick is placed.
Figure 2:
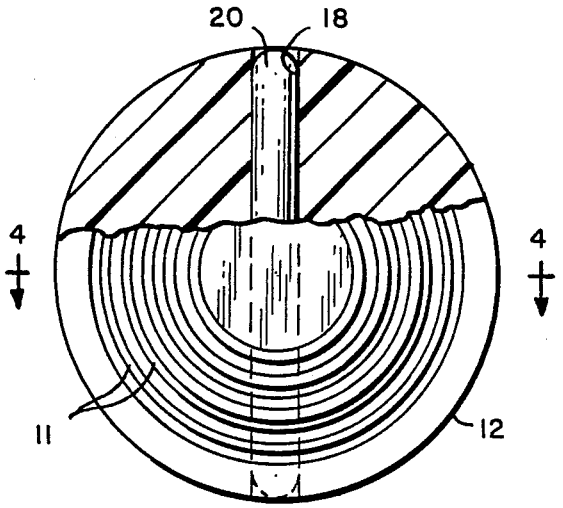
FIG. 2 is an axial or plan view of the puck of the present invention, partially cut away, showing the light stick in position in the hole.

Referring first to FIGS. 1 and 2, there is illustrated a translucent plastic hockey puck 12, the specific composition of which will be detailed below. The finished puck is substantially cylindrical in shape, about 1 inch thick at its outermost edge, and about 3" wide in diameter.

Puck 12 is provided with a longitudinally extending, diametrical passageway 18, which passes completely through the puck from side to side. This hole may be made in the puck molding process or it may be drilled through the finished puck.

Figure 3:
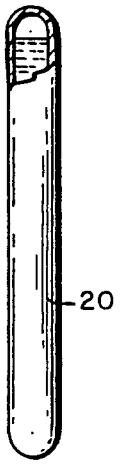
FIG. 3 is a longitudinal view of the light stick, partially cut away, showing one of the chemiluminescent fluids contained therein.

A chemiluminescent light stick 20, shown in FIG. 3, may be inserted into hole 18 after activation for play at night. The light stick 20 is activated by manually bending it until a vial therein (not shown) breaks to allow the separated chemicals to mix and thereafter give off light. For further information regarding the nature of chemiluminescent light sticks, see, e.g., U.S. Pat. Nos. 3,597,362 and 3,539,794, which are hereby incorporated herein by reference.

The light stick 20 should be roughly the same diameter as the passageway 18. If the light stick is slightly larger in diameter than the hole 18, it can be forced by hand into the hole and centered by pushing it with the end of another light stick, or similar sized object to place each end below the edge of the puck surface.

In preferred embodiments, the light stick is held in place by friction against the hole wall but it is to be understood that any other means for keeping the light stick in removable position, e.q.. with tape, or other non-permanent securing means, may be used. Since the light stick has a limited life, it is clear that the light stick must be removable so that another activated light stick may be inserted when illumination of the puck is again desired.

A dead light stick may be removed from the puck by pushing it with the end of another light stick, pencil, pen, twig, or the like, enough to permit the other end to be gripped, e.g. by the fingers and pulled out of the puck.

Figure 4:
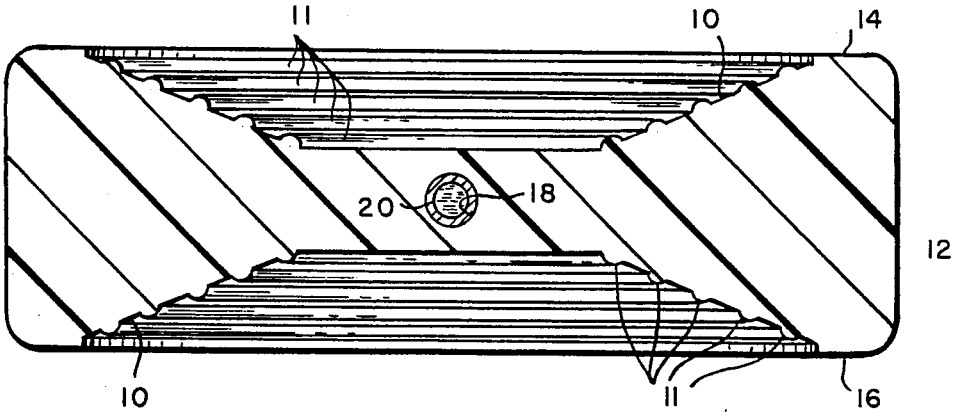
FIG. 4 is a cross-sectional view taken along lines 4—4 of FIG. 2, illustrating one preferred structural design of the puck of the present invention in enlarged form.

As illustrated in FIG. 4, the puck may be further provided with concave depressions 10 on either face, 14 and 16. The presence of the concave faces on the puck reduces friction of the puck, allowing it to travel rapidly across the ice.

In addition, it has been discovered that by adding a plurality of spaced apart ridges 11 to the concave depressions 10, the light emanating from the hockey puck is diffused, thereby improving its visibility in the dark. See, FIGS. 2 and 4, for preferred ridge spacings and shapes.

As described above, any of the translucent plastic materials available today may be used to create the puck of the present invention. Preferably these materials should have sufficient densities and resiliencies to react as a conventional ice hockey puck when struck with a hockey stick.

Several translucent plastic materials and mixtures thereof have been used for the formation of hockey pucks in accordance with the teachings of the present invention. These include ethyl vinyl acetate polymers (EVA) and low density polyethylene polymers (LDPE), as well as mixtures of these materials. For example, pucks may be prepared by injection molding a mixture of 75 wt. percent EVA and 25 percent LDPE, or from 100 percent of either ingredient.

The currently preferred material from which the puck of the present invention is made is from 100 percent EVA supplied by DuPont of Wilmington, Del. although it will be understood that the same or similar material may be made by others.

To produce the puck, the molder injects the aforesaid material in liquid or pellet form into a correctly sized mold and then subjects it to heat and pressure according to known processes.

After molding, the passageway is formed in the puck by drilling, and the puck is ready to be used.

It will be appreciated that the puck as described above can be employed in daylight or under other lighted conditions as if it were a conventional puck. The presence of the longitudinal/diametrical hole does not effect the playability of the puck.

However, for night play, a chemiluminescent light stick is first activated and then inserted into the puck. Such a light stick will last several hours, thereby extending play well beyond those times previously possible with conventional hockey pucks.

For convenience of night hockey players, the puck of the present invention is sold by Pick Point Sports of Mirror Lake, N.H. 03853, under the trademark "NITE-LITE" with two CYALUME light sticks, because after an extended period of time in cold environments, the intensity of the light output of the CYALUME light sticks can begin to fade.

By keeping one activated light stick warm on the person of the hockey player, a bright light stick can readily be inserted into the puck, and the removed light stick will shortly thereafter become reactivated by the body warmth of the player holding it. By repeatedly interchanging the warm and thus bright light stick for the cool and dim one, play can continue for many hours.

It is urged that proper protective equipment be worn at all times when using the hockey puck of the present invention at night. In particular, helmets and face shields are a must when playing hockey at night. In addition, the goals and opposing players should be appropriately illuminated by the use of larger CYALUME light sticks which are commercially available from American Cyanamid Co.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A hockey puck designed for use at night comprising a substantially cylindrical member of molded translucent plastic material, said cylindrical member being in the shape and size of a conventional hockey puck and further being provided with a permanent longitudinally and diametrically extending passageway, said passageway being of sufficient size to removably accept and retain a chemiluminescent light stick having a length substantially the same as the diameter of the cylindrical member, which when activated renders the cylindrical member visible in the dark.

2. The hockey puck of claim 1, which further comprises a chemiluminescent light stick in the passageway.

3. The hockey puck of claim 2, wherein the light stick is activated.

4. The hockey puck of claim 2, wherein the light stick is dead.

5. The hockey puck of claim 1, 2, 3, or 4, wherein the translucent plastic is ethyl vinyl acetate polymer, low density polyethylene polymer, or mixtures thereof.

6. The hockey puck of claim 5, wherein the translucent plastic is ethyl vinyl acetate.

7. The hockey puck of claim 1, 2, 3, or 4, which weighs about 3 ounces.

* * * * *